United States Patent [19]

Cosco et al.

[11] 3,993,922

[45] Nov. 23, 1976

[54] ARC DISCHARGE LAMP WITH INTEGRAL TRIGGER ELECTRODE

[75] Inventors: Robert J. Cosco, Amesbury; John A. Pappas, Winthrop; Roger T. Hebert, Peabody, all of Mass.

[73] Assignee: GTE Sylvania Incorporated, Danvers, Mass.

[22] Filed: Jan. 5, 1976

(Under Rule 47)

[21] Appl. No.: 646,506

[52] U.S. Cl. ..... 313/198; 313/113; 313/201; 313/220

[51] Int. Cl.[2] ..... H01J 61/30; H01J 61/35; H01J 61/54

[58] Field of Search ..... 313/197, 198, 201, 184, 313/220, 113

[56] References Cited

UNITED STATES PATENTS

| | | | |
|---|---|---|---|
| 3,775,641 | 11/1973 | Goldberg | 313/198 X |
| 3,909,660 | 9/1975 | Sulcs et al. | 313/198 X |

*Primary Examiner*—Palmer C. Demeo

*Attorney, Agent, or Firm*—James H. Grover

[57] ABSTRACT

A high voltage xenon filled flash tube has a trigger conductor wire embedded in the glass envelope of the tube or in an aluminum reflector on the tube. The wire does not penetrate the glass envelope nor enter the gas filled volume through which arc discharge occurs.

6 Claims, 6 Drawing Figures

ARC DISCHARGE LAMP WITH INTEGRAL TRIGGER ELECTRODE

BACKGROUND OF THE INVENTION

High voltage arc discharge flash tubes periodically or intermittently discharge a very high intensity between anodic and cathodic electrodes within a glass or quartz envelope having a fill of xenon gas, for example.

Thousands of volts are applied from high capacity storage condensers across the electrodes, but an arc does not strike easily unless triggered by ionizing the gas fill. Commonly ionization is triggered by a high voltage pulse (e.g. 6 Kilovolts) applied to a wire conductor wrapped around the envelope, or in some cases penetrating the envelope into the gaseous arc discharge volume.

With both wrapped or penetrating trigger wires a very high applied discharge voltage is required, resulting in the need for high voltage and expensive storage capacitors and slow and unreliable starting.

Accordingly, objects of the present invention are to provide a high voltage, arc discharge flash tube with an improved trigger conductor affording fast and reliable starting of the discharge arc at lowered applied voltages.

STATEMENT OF INVENTION

According to the invention a high voltage, arc discharge flash tube comprises an elongate envelope including a wall enclosing an arc discharge volume, arc supporting electrodes spaced apart inside the envelope, and a trigger conductor for applying an electrical pulse initiating discharge of the arc, wherein the trigger conductor partially penetrates the envelope wall to an extent outside the arc volume so as to distribute the electrical field of the pulse along the arc discharge volume.

DRAWINGS

DESCRIPTION

Figure 1:
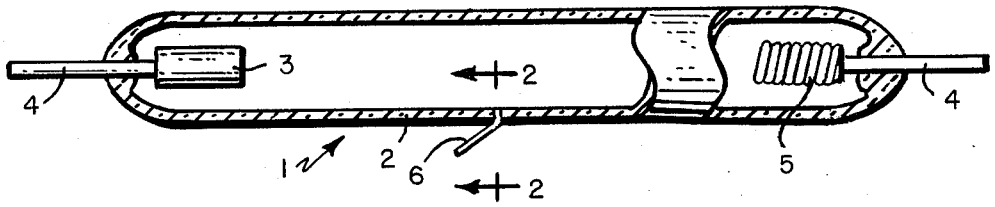
FIG. 1 is a general view, partly in section, of an arc discharge flash tube with a trigger wire embedded in the lamp envelope.
Figure 2:
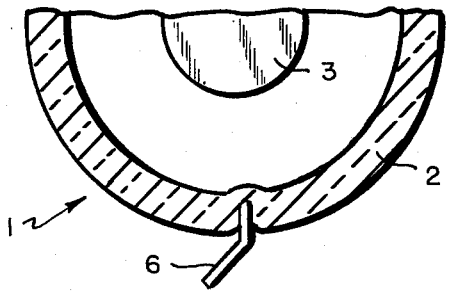
FIG. 2 is a section on line 2—2 of FIG. 1.

In FIGS. 1 and 2 a high voltage flash tube 1 comprises a glass envelope 2 with a fill of xenon gas. Lead wires 4 entering the envelope are electrically connected to, and support a cathode 3 and an anode 5. Inside the envelope between the cathode and anode is the gaseous arc discharge column which, when ionized supports the electrical arc discharge.

According to the form of invention a trigger wire or like conductor 6 is embedded in the wall of the envelope, partially penetrating the wall but not extending through the wall to the arc discharge volume. Preferably the trigger conductor 6 penetrates at least 50% of the wall thickness and is located along the arc discharge volume between the anode and cathode, in the middle as shown in FIG. 1, or even more preferably close to the cathode 3, as shown in FIG. 3.

As in prior flash tubes the function of the trigger conductor 6 is to receive a multi-thousand volt pulse from a pulse transformer and electrostatically ionize the gas fill in the arc discharge column, thereby to initiate and maintain a momentary arc between the cathode and anode. It has been found that the present embedded trigger causes the arc to strike at a substantially lower voltage applied across the anodic and cathodic electrodes, than a flash tube with a trigger wire wrapped around the exterior of the flash tube or with a trigger wire penetrating through the flash tube envelope wall into the arc discharge column. It is believed that the embedded trigger reduces the impedance of the trigger circuit and produces stronger coupling with a large volume of the gas fill. Radio frequency noise is reduced, and quicker and more reliable starting occurs.

Figure 4:
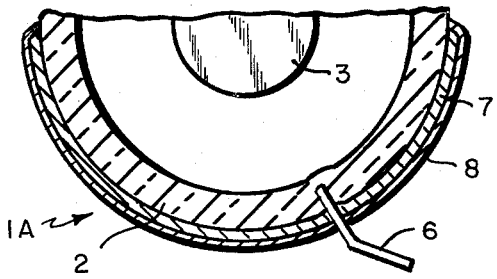
FIG. 4 is a section on lines 4—4 of FIG. 3.
Figure 3:
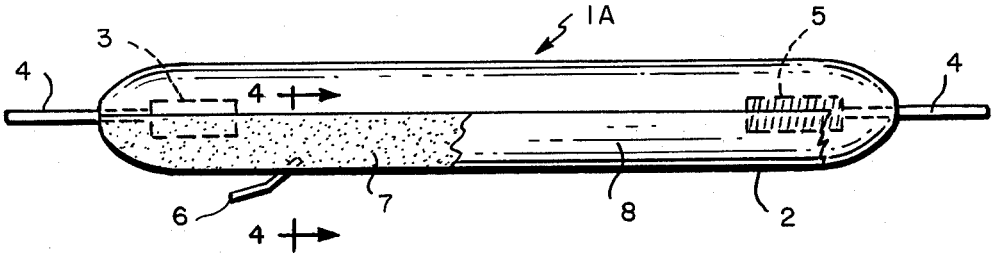
FIG. 3 is a view like FIG. 1 of a flash tube with an aluminized coating.

The flash tube 1A shown in FIGS. 3 and 4 is like that of FIGS. 1 and 2 with the addition of a reflective aluminum coating 7 on the envelope 2, the coating 7 having a thin oxidized layer 8. The trigger wire 6 makes electrical connection with the aluminum coating as well as partially penetrating the envelope wall. Distinctly improved arc ignition results at lower ionization potential than with wrapped or penetrating trigger wires.

Figure 5:
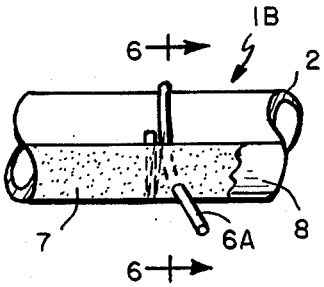
FIG. 5 is a fragmentary view of a lamp with a trigger wire embedded in an aluminum coating.
Figure 6:
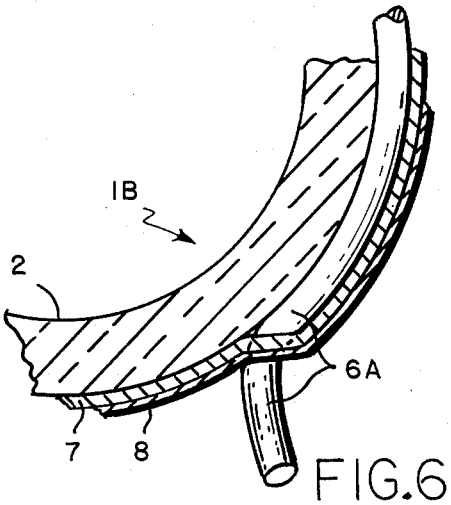
FIG. 6 is a section on line 6—6 of FIG. 5.

In FIGS. 5 and 6 the envelope 2 of the flash tube 1B includes the reflective aluminum coating 7 and alumina layer 8 as in FIGS. 3 and 4, and the trigger wire 6A is embedded under the aluminum coating. This form of embedment is substantially as effective as the forms of FIGS. 1 to 4, although it will be understood that it is useful only in reflectorized flash tubes, whereas the embedment of FIGS. 1 and 2 is in unreflectorized tubes.

It should be understood that the present disclosure is for the purpose of illustration only and that this invention includes all modifications and equivalents which fall within the scope of the appended claims.

We claim:

1. A high voltage, arc discharge flash tube comprising:

an elongate light transmitting envelope including a wall enclosing an arc discharge volume and having a rare gas sealed therein, arc supporting electrodes spaced apart inside the envelope, and a trigger conductor for applying an electrical pulse initiating discharge of the arc, wherein the trigger conductor partially penetrates the envelope wall to an extent outside the arc volume so as to distribute the electrical field of the pulse along the arc discharge volume.

2. A flash tube according to claim 1 wherein the trigger conductor is embedded in a glass wall.

3. A flash tube according to claim 2 wherein the trigger conductor penetrates at least 50% of the envelope wall thickness.

4. A flash tube according to claim 1 wherein the trigger conductor is embedded under a metallic coating.

5. A flash tube according to claim 1 wherein the conductor is disposed opposite the arc discharge volume.

6. A flash tube according to claim 4 wherein said arc supporting electrodes comprise a cathode and anode, the trigger conductor being located proximate the cathode.

* * * * *

UNITED STATES PATENT AND TRADEMARK OFFICE

CERTIFICATE OF CORRECTION

PATENT NO. : 3,993,922

DATED : November 23, 1976

INVENTOR(S) : Robert J. Cosco, John A. Pappas, Roger T. Hebert

It is certified that error appears in the above-identified patent and that said Letters Patent are hereby corrected as shown below:

On the Title Page, item [22], delete:

"(Under Rule 47)"

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*